US009453671B2

(12) United States Patent
Shimazu

(10) Patent No.: US 9,453,671 B2
(45) Date of Patent: Sep. 27, 2016

(54) REFRIGERATING AND AIR-CONDITIONING APPARATUS AND METHOD FOR CONTROLLING REFRIGERATING AND AIR-CONDITIONING APPARATUS

(75) Inventor: Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 277 days.

(21) Appl. No.: 14/128,167

(22) PCT Filed: Jul. 7, 2011

(86) PCT No.: PCT/JP2011/003895

§ 371 (c)(1),
(2), (4) Date: Dec. 20, 2013

(87) PCT Pub. No.: WO2013/005260

PCT Pub. Date: Jan. 10, 2013

(65) Prior Publication Data

US 2014/0123693 A1 May 8, 2014

(51) Int. Cl.

*F25B 49/02* (2006.01)
*F25B 49/00* (2006.01)
*F25B 13/00* (2006.01)

(52) U.S. Cl.

CPC ..... *F25B 49/02* (2013.01); *F25B 49/00* (2013.01); *F25B 13/00* (2013.01); *F25B 2700/1931* (2013.01); *F25B 2700/1933* (2013.01); *F25B 2700/21151* (2013.01); *F25B 2700/21152* (2013.01)

(58) Field of Classification Search

CPC ..... F25B 9/002; F25B 9/006
See application file for complete search history.

(56) References Cited

U.S. PATENT DOCUMENTS 5,353,604 A * 10/1994 Oguni et al. ..... 62/207
5,651,263 A * 7/1997 Nonaka et al. ..... 62/205

(Continued)

FOREIGN PATENT DOCUMENTS

CN 1139750 A 1/1997
EP 0 898 133 A2 2/1999

(Continued)

OTHER PUBLICATIONS

Machine Translation for Nonaka et al. (JP H10-160273).*

(Continued)

*Primary Examiner* — Ryan J Walters
*Assistant Examiner* — Antonio R Febles
(74) *Attorney, Agent, or Firm* — Posz Law Group, PLC

(57) ABSTRACT

A refrigerating and air-conditioning apparatus, which includes a compressor, a condenser, an expansion device, and an evaporator, has a refrigeration cycle configured by these components being connected by a refrigerant pipe, and uses a non-azeotropic refrigerant mixture as a refrigerant circulating through the refrigeration cycle, includes operating state detection means which detect a pressure of the refrigerant at the compressor, a temperature of the refrigerant at the compressor, and a rotation speed of the compressor, output detection means which detects an output of the compressor, and composition detection means which calculates a correlation between the pressure of the refrigerant at the compressor, the temperature of the refrigerant at the compressor, the rotation speed of the compressor, the output of the compressor, and a refrigerant composition and retains data indicating the correlation.

12 Claims, 5 Drawing Sheets

(56) References Cited

U.S. PATENT DOCUMENTS

| | | | | |
|---|---|---|---|---|
| 5,709,094 | A | 1/1998 | Ooyabu et al. | |
| 5,737,931 | A * | 4/1998 | Ueno et al. | 62/126 |
| 5,941,084 | A * | 8/1999 | Sumida et al. | 62/129 |
| 5,996,358 | A * | 12/1999 | Sumida | C09K 5/045 62/114 |
| 6,247,320 | B1 * | 6/2001 | Sumida | C09K 5/045 62/114 |
| 2003/0019221 | A1 * | 1/2003 | Rossi et al. | 62/127 |
| 2010/0122545 | A1 * | 5/2010 | Minor et al. | 62/324.1 |

FOREIGN PATENT DOCUMENTS

| | | | |
|---|---|---|---|
| JP | 08-254363 | A | 10/1996 |
| JP | 08-261576 | A | 10/1996 |
| JP | 10-160273 | A | 6/1998 |
| JP | 11-063747 | A | 3/1999 |
| JP | 2001-099501 | A | 4/2001 |
| JP | 2010-002090 | A | 1/2010 |
| WO | 2009/154149 | A1 | 12/2009 |

OTHER PUBLICATIONS

Extended European Search Report dated Jan. 27, 2015 issued in corresponding EP patent application No. 11868973.6.

Office Action mailed Oct. 21, 2014 issued in corresponding JP patent application No. 2013-522369 (and English translation).

Office Action dated Feb. 27, 2015 issued in corresponding CN patent application No. 201180072135.3 (and English translation).

International Search Report of the International Searching Authority mailed Oct. 11, 2011 for the corresponding international application No. PCT/JP2011/003895 (and English translation).

* cited by examiner

REFRIGERATING AND AIR-CONDITIONING APPARATUS AND METHOD FOR CONTROLLING REFRIGERATING AND AIR-CONDITIONING APPARATUS

CROSS REFERENCE TO RELATED APPLICATION

This application is a U.S. national stage application of International Application No. PCT/JP2011/003895 filed on Jul. 7, 2011.

TECHNICAL FIELD

The present invention relates to a refrigerating and air-conditioning apparatus that uses a non-azeotropic refrigerant mixture as a refrigerant, and particularly relates to a refrigerating and air-conditioning apparatus that is modified to improve accuracy of detecting the composition of the refrigerant.

BACKGROUND ART

In a refrigerating and air-conditioning apparatus that uses a non-azeotropic refrigerant mixture, since the boiling points of refrigerants included in the non-azeotropic refrigerant mixture are different from each other, the composition of the circulating refrigerant may change. Particularly, when the size of a refrigerating and air-conditioning apparatus is large, a change in the refrigerant composition becomes noticeable. As described above, when the refrigerant composition changes, changes in the condensing temperature or the evaporating temperature may occur even there is no change in the pressure. In other words, an improper refrigerant saturation temperature at a heat exchanger hinders the refrigerant from being readily condensed and liquefied or evaporated and gasified at the heat exchanger, and the heat exchange efficiency may be reduced.

In addition, when the refrigerant composition changes, changes in superheat or subcooling may occur even there are no changes in the temperature and pressure at the refrigerant discharge side of the heat exchanger. In other words, owing to improper superheat before the refrigerant is sucked onto a compressor, a liquid refrigerant flows into the compressor, whereby the compressor may consequently be damaged; or owing to improper subcooling before the refrigerant flows into an expansion valve, the refrigerant comes into a gas-liquid two-phase state, whereby generation of refrigerant sound or an unstable phenomenon may consequently occur.

Here, it is known that a refrigerating and air-conditioning apparatus including a refrigerant storage container (receiver) at a high-pressure side has a smaller fluctuation range of the composition of a circulating refrigerant than that of a refrigerating and air-conditioning apparatus including a refrigerant storage container (accumulator) at a low-pressure side. However, when refrigerant leak occurs at a refrigeration cycle, the fluctuation range of the refrigerant composition is increased regardless of whether the refrigerant storage container is at the low-pressure side or the high-pressure side. In other words, it is possible to detect refrigerant leak by detecting a fluctuation of the refrigerant composition.

Thus, various refrigerating and air-conditioning apparatuses including means for detecting a refrigerant composition in order to suppress reduction in heat exchange efficiency, to avoid compressor damage, to suppress generation of refrigerant sound, to suppress an unstable phenomenon, and to detect refrigerant leak, have been proposed.

As such a refrigerating and air-conditioning apparatus, a refrigerating and air-conditioning apparatus has been proposed which includes a bypass connected so as to bypass a compressor and in which a double pipe heat exchanger and a capillary tube are connected to the bypass (e.g., see Patent Literature 1). In the technology described in Patent Literature 1, the temperature at the refrigerant inflow side of the capillary tube, the temperature at the refrigerant outflow side of the capillary tube, and the pressure at the refrigerant outflow side of the capillary tube are detected, and a refrigerant composition is calculated on the basis of these detection results.

In addition, as such a refrigerating and air-conditioning apparatus, a refrigerating and air-conditioning apparatus has been proposed which detects an excess refrigerant amount within an accumulator and calculates a refrigerant composition (e.g., see Patent Literature 2). In other words, in the technology described in Patent Literature 2, a refrigerant composition is calculated on the basis of a correlation between information such as the number of operating indoor units and the outside air temperature and a previously obtained refrigerant composition, an excess refrigerant amount within the accumulator is detected, and the calculated refrigerant composition is corrected, whereby the composition of a circulating refrigerant is calculated.

CITATION LIST

Patent Literature

Patent Literature 1: Japanese Unexamined Patent Application Publication No. 11-63747 (e.g., see paragraphs [0027] to [0029] of the specification)

Patent Literature 2: Japanese Unexamined Patent Application Publication No. 2001-99501 (e.g., see paragraphs [0041], [0042], and [0051] to [0053] of the specification)

SUMMARY OF INVENTION

Technical Problem

The technology described in Patent Literature 1 is configured to detect a composition on the basis of states before and after an expansion process at the capillary tube. For example, when a plurality of expansion processes are present in parallel in a refrigeration cycle of the refrigerating and air-conditioning apparatus, the detection accuracy of a refrigerant composition to be detected may be decreased.

In the technology described in Patent Literature 1, since the bypass is provided, an amount of the refrigerant circulating through the refrigeration cycle is reduced. Thus, the capability exerted by the refrigerating and air-conditioning apparatus is diminished, and the operation reliability of the refrigerating and air-conditioning apparatus may be decreased.

In addition, in the technology described in Patent Literature 1, when a liquid refrigerant flows into the compressor during a transient operation and a two-phase refrigerant flows out also from a refrigerant pipe at the discharge side of the compressor, the refrigerant having the same refrigerant composition as that of the refrigerant circulating through the refrigeration cycle may not flow into the bypass when branching into the bypass. In this case, even when a refrigerant composition is detected in the bypass path, it does not mean that a composition of the refrigerant circulating through the refrigeration cycle is detected. Therefore, even when a liquid refrigerant flows into the compressor, the detection thereof is failed whereby the compressor may consequently be damaged, and accordingly, the operation reliability of the refrigerating and air-conditioning apparatus may be decreased.

Furthermore, in the technology described in Patent Literature 1, since the double pipe heat exchanger and the capillary tube are provided, the cost is increased.

In the technology described in Patent Literature 2, since a liquid level detector is provided in the accumulator, the cost is increased.

In addition, in the technology described in Patent Literature 2, it is necessary to previously grasp a refrigerant composition from an operating state of the refrigerating and air-conditioning apparatus, and a considerable amount of evaluation work or simulation is required for each refrigerating and air-conditioning apparatus. Thus, the load and the cost of development are increased.

A refrigerating and air-conditioning apparatus according to the present invention intends to provide a refrigerating and air-conditioning apparatus that has improved accuracy of detecting the composition of a circulating refrigerant and has improved operation reliability during operation while suppressing a cost increase.

Solution to Problem

A refrigerating and air-conditioning apparatus according to the present invention includes a compressor, a condenser, an expansion device, and an evaporator, has a refrigeration cycle configured by these components being connected by a refrigerant pipe, and uses a non-azeotropic refrigerant mixture as a refrigerant circulating through the refrigeration cycle. The refrigerating and air-conditioning apparatus includes: operating state detection means for detecting an operating state of the compressor; output detection means for detecting an output of the compressor; and composition detection means for calculating a correlation between the operating state, the output, and a refrigerant composition and retaining data indicating the correlation. The composition detection means calculates a composition of the refrigerant circulating through the refrigeration cycle on the basis of a detection result of the operating state detection means, a detection result of the output detection means, and the data indicating the correlation.

Advantageous Effects of Invention

In the refrigerating and air-conditioning apparatus according to the present invention, the composition detection means calculates the composition of the refrigerant circulating through the refrigeration cycle, on the basis of the detection result of the operating state detection means, the detection result of the output detection means, and the data indicating the correlation. Thus, while suppressing a cost increase, the improvement in accuracy of detecting the composition of the circulating refrigerant is ensured, and this improves the operation reliability during operation.

DESCRIPTION OF EMBODIMENTS

Hereinafter, embodiments of the present invention will be described with reference to the drawings.

Embodiment 1

Figure 1:
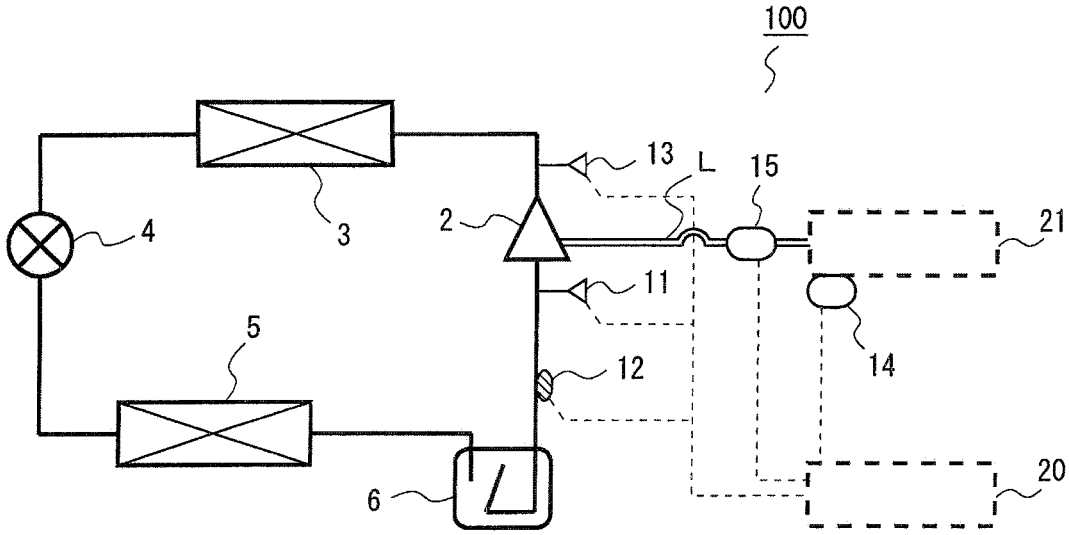
FIG. 1 shows an example of a refrigerant circuit configuration of a refrigerating and air-conditioning apparatus according to Embodiment 1 of the present invention.

FIG. 1 shows an example of a refrigerant circuit configuration of a refrigerating and air-conditioning apparatus 100 according to Embodiment 1 of the present invention.

The refrigerating and air-conditioning apparatus 100 according to Embodiment 1 uses a non-azeotropic refrigerant mixture as a refrigerant, and performs control of various devices such as an opening degree of an expansion device (corresponding to a pressure reducing mechanism 4 described later) by detecting the refrigerant composition of the refrigerant. The refrigerating and air-conditioning apparatus 100 according to Embodiment 1 is modified to improve accuracy of detecting the composition of the refrigerant.

It should be noted that in the following description, a composition (refrigerant composition) refers to the composition of a refrigerant circulating through a refrigeration cycle, and is not the composition of a refrigerant to be charged and the composition of a refrigerant present within a component of the refrigeration cycle.

As shown in FIG. 1, the refrigerating and air-conditioning apparatus 100 includes a compressor 2 which compresses the refrigerant, a condenser 3 which condenses and liquefies the refrigerant, the pressure reducing mechanism 4 which reduces the pressure of the refrigerant to expand the refrigerant, an evaporator 5 which evaporates and gasifies the refrigerant, and an accumulator 6 which stores an excess refrigerant, and has a refrigeration cycle configured by these components being connected by a refrigerant pipe. Here, the refrigerating and air-conditioning apparatus 100 uses the non-azeotropic refrigerant mixture as a refrigerant circulating through the refrigeration cycle. In Embodiment 1, as the non-azeotropic refrigerant mixture, R32 (a charged composition of R32 is 54 wt %) is used as a low-boiling-point refrigerant, and HFO1234yf (the charged composition thereof is 46 wt %) is used as a high-boiling-point refrigerant. It should be noted that in the case of this charged refrigerant composition, the global warming potential (GWP) of the non-azeotropic refrigerant mixture is 300.

In addition, the refrigerating and air-conditioning apparatus 100 includes various devices for detecting the composition of the non-azeotropic refrigerant mixture. Specifically, the refrigerating and air-conditioning apparatus 100 includes suction-side pressure detection means 11 which detects the pressure of the refrigerant sucked into the compressor 2, suction-side temperature detection means 12 which detects the temperature of the refrigerant sucked into the compressor 2, discharge-side pressure detection means 13 which detects the pressure of the refrigerant discharged from the compressor 2, rotation speed detection means 14 which detects the rotation speed of the compressor 2, and output detection means 15 which detects an output of the compressor 2.

Furthermore, the refrigerating and air-conditioning apparatus 100 includes composition detection means 20 which detects a refrigerant composition on the basis of detection results of these detection means 11 to 15, and a controller 21 which integrally controls the rotation speed of the compressor 2 and various devices.

The compressor 2 sucks the refrigerant, compresses the refrigerant into a high-temperature and high-pressure state, and discharges the refrigerant. The compressor 2 is connected at a discharge side thereof to the condenser 3 and connected at a suction side thereof to the accumulator 6. The compressor 2 may be, for example, a capacity-controllable inverter compressor or the like.

The condenser 3 condenses and liquefies the high-temperature and high-pressure refrigerant supplied from the compressor 2. The condenser 3 is connected at one end thereof to the compressor 2 and connected at another end thereof to the pressure reducing mechanism 4. It should be noted that the condenser 3 is equipped with a fan (not shown) and prompts heat exchange between the refrigerant and air supplied from the fan. The air that is heat-exchanged with the refrigerant is blown out to, for example, the outside of a room or the like by the action of the fan.

The pressure reducing mechanism 4 reduces the pressure of a liquid refrigerant flowing thereinto from the condenser 3, to expand the liquid refrigerant. The pressure reducing mechanism 4 may be a mechanism whose opening degree is variably controllable, such as an electronic expansion valve. The pressure reducing mechanism 4 is connected at one end thereof to the condenser 3 and connected at another end thereof to the evaporator 5.

The evaporator 5 evaporates and gasifies a gas-liquid two-phase refrigerant flowing thereinto from the pressure reducing mechanism 4. The evaporator 5 is connected at one end thereof to the pressure reducing mechanism 4 and connected at another end thereof to the accumulator 6. It should be noted that the evaporator 5 is equipped with a fan (not shown) and prompts heat exchange between the refrigerant and air supplied from the fan. The air that is heat-exchanged with the refrigerant is blown out to an air-conditioned space (e.g., the inside of a room, a storehouse, etc.) by the action of the fan.

The accumulator 6 stores an excess refrigerant caused by a change of a transient operation (e.g., a change of the output of the compressor 2). The accumulator 6 is connected at one end thereof to the evaporator 5 and connected at another end thereof to the suction side of the compressor 2.

The suction-side pressure detection means 11 detects the pressure of the refrigerant sucked into the compressor 2 (low-pressure-side refrigerant pressure), and is, for example, a pressure sensor or the like. In other words, the suction-side pressure detection means 11 detects the pressure of the refrigerant whose pressure is reduced by the action of the pressure reducing mechanism 4, in order to detect a refrigerant composition. In addition, the suction-side pressure detection means 11 is connected to the composition detection means 20. Here, FIG. 1 illustrates an example where the suction-side pressure detection means 11 is installed on a refrigerant pipe near an inlet of the compressor 2, but the present invention is not limited thereto. Specifically, the suction-side pressure detection means 11 may be installed on a refrigerant pipe (including the evaporator 5 and the accumulator 6) from a refrigerant outlet of the pressure reducing mechanism 4 to the inlet of the compressor 2. By so doing, it is possible to commonalize the suction-side pressure detection means 11 with a pressure detection sensor (not shown) for controlling the rotation speed of the fan of the condenser 3, the opening degree of the pressure reducing mechanism 4, and the like, into one unit, and thus it is possible to reduce the cost.

The suction-side temperature detection means 12 detects the temperature of the refrigerant sucked into the compressor 2 (low-pressure-side refrigerant temperature), and is, for example, a temperature sensor or the like. In addition, the suction-side temperature detection means 12 is connected to the composition detection means 20. Here, FIG. 1 illustrates an example where the suction-side temperature detection means 12 is installed on a refrigerant pipe connecting the accumulator 6 to the compressor 2, but the present invention is not limited thereto. Specifically, the suction-side temperature detection means 12 may be installed inside the compressor 2 and at a position before the refrigerant is compressed (at a position before entering a compression process).

Here, when the suction-side temperature detection means 12 is provided on the pipe surface, the suction-side temperature detection means 12 is susceptible to the ambient environment (disturbance). For example, when one type of compressors are installed in a plurality of different refrigerating and air-conditioning apparatuses, there is a possibility that the installation position of the suction-side temperature detection means 12 differs in each refrigerating and air-conditioning apparatus, and the suction-side temperature detection means 12 is affected by an error of detection results or the like caused by the difference in installation position.

However, installing the suction-side temperature detection means 12 inside the compressor 2 and at the position before the refrigerant is compressed, suppresses such disturbance, and it is therefore possible to detect a refrigerant composition with high accuracy.

The discharge-side pressure detection means 13 detects the pressure of the refrigerant discharged from the compressor 2 (high-pressure-side refrigerant pressure), and is, for example, a pressure sensor or the like. In other words, the discharge-side pressure detection means 13 detects the pressure of the refrigerant whose pressure is increased by the action of the compressor 2. In addition, the discharge-side pressure detection means 13 is connected to the composition detection means 20. Here, FIG. 1 illustrates an example where the discharge-side pressure detection means 13 is installed on a refrigerant pipe near an outlet of the compressor 2, but the present invention is not limited thereto. Specifically, the discharge-side pressure detection means 13 may be installed on a refrigerant pipe (including the condenser 3) from the outlet of the compressor 2 to a refrigerant inlet of the pressure reducing mechanism 4. By so doing, it is possible to commonalize the discharge-side pressure detection means 13 with a pressure detection sensor (not shown) for controlling the rotation speed of the fan of the evaporator 5, the opening degree of the pressure reducing mechanism 4, and the like, into one unit, and thus it is possible to reduce the cost.

The rotation speed detection means 14 detects the rotation speed of the compressor 2, and is, for example, a non-contact rotation speed sensor or the like. It should be noted that a method of the rotation speed detection means 14 for detecting a rotation speed is not limited to this, and may be a method in which a command value output to the compressor 2 by control means 21 which controls the rotation speed of the compressor 2 is used as a rotation speed. In addition, the rotation speed detection means 14 is connected to the composition detection means 20.

As described above, the suction-side pressure detection means 11, the suction-side temperature detection means 12, the discharge-side pressure detection means 13, and the rotation speed detection means 14 detect an operating state of the compressor 2, and these detection means 11 to 14 constitute operating state detection means.

The output detection means 15 detects the output of the compressor 2. The output detection means 15 is connected between the compressor 2 and the controller 21 via a power supply line L. Thus, the output detection means 15 is able to detect power supplied from a power source, which is not shown, via a controller 20 to the compressor 2. In addition, the output detection means 15 is connected to the composition detection means 20.

The composition detection means 20 has stored therein functions described in formulas 1 to 8 described below, and calculates the power consumption of the compressor 2 on the basis of detection results of the suction-side pressure detection means 11, the suction-side temperature detection means 12, the discharge-side pressure detection means 13, and the rotation speed detection means 14 and formulas 1 to 8. The composition detection means 20 is composed of, for example, a microcomputer or an electronic circuit equivalent to the microcomputer. The composition detection means 20 calculates a refrigerant composition on the basis of the calculated power consumption of the compressor 2 and a detection result of the output detection means 15. It should be noted that it is stated that the composition detection means 20 has stored therein the functions described in formulas 1 to 8, and it means that the functions have been formulated by polynomials of arguments (Pd, Ps, Ts, $\alpha$, N, etc.) and stored therein.

The composition detection means 20 is connected to the detection means 11 to 15. It should be noted that the composition detection means 20 may be connected to the detection means 11 to 15 via wires or wirelessly, and the present invention is not particularly limited.

The composition detection means 20 may not be in a form in which the functions described in formulas 1 to 8 have been stored therein. The composition detection means 2 may be in a form in which a data table corresponding to formulas 1 to 8 has been created and stored so as to appropriately interpolate data therein. Accordingly, creating the data table can reduce a calculation time, and thus the controllability of the composition detection means 20 can be stabilized.

In addition, in the refrigerating and air-conditioning apparatus 100 according to Embodiment 1, the composition detection means 20 detects the refrigerant composition of the low-boiling-point refrigerant. Specifically, the composition detection means 20 has stored therein formulas for the low-boiling-point refrigerant, and a data table. When the value of the refrigerant composition of the low-boiling-point refrigerant is $\alpha$, the refrigerant composition of the high-boiling-point refrigerant is calculated by $1-\alpha$.

Furthermore, the composition detection means 20 may previously have stored therein the formulas and the data table, and also may be the one capable of setting and updating the formulas and the data table later on.

The controller 21 controls operations such as the opening degree of the pressure reducing mechanism 4, the rotation speed of the compressor 2, and the rotation speeds of the fans provided in the condenser 3 and the evaporator 5, respectively. The controller 21 of the refrigerating and air-conditioning apparatus 100 according to Embodiment 1 is able to control operations of the various devices descried above on the basis of a detection result of the composition detection means 20. In addition, the controller 21 is connected to the power source which is not shown, and is connected to the output detection means 15 and the compressor 2 via the power supply line L.

A refrigerant operation of the refrigerating and air-conditioning apparatus 100 will be described. The high-temperature and high-pressure gas refrigerant compressed by the compressor 2 flows into the condenser 3 and condenses and liquefies. The liquid refrigerant having flowed out of the condenser 3 flows into the pressure reducing mechanism 4 and is reduced in pressure. The low-pressure gas-liquid two-phase refrigerant having flowed out of the pressure reducing mechanism 4 flows into the evaporator 5 and evaporates and gasifies. The gas refrigerant having flowed out of the evaporator 5 flows into the accumulator 6 in which an excess refrigerant occurring depending on an operating condition or a load condition of the refrigerating and air-conditioning apparatus 100 is stored. The gas refrigerant having flowed out of the accumulator 6 is sucked and compressed again by the compressor 2.

Here, the reasons why the refrigerant composition changes will be described as the following three examples. It should be noted that a change in the refrigerant composition refers to a change in the composition of the refrigerant circulating through the refrigeration cycle with respect to the composition of the refrigerant charged in the refrigeration cycle.

(1) The refrigerant within the accumulator 6 is separated into a liquid phase in which the high-boiling-point refrigerant (HFO1234) is contained in a large amount and a gas phase in which the low-boiling-point refrigerant (R32) is contained in a large amount. Then, the liquid-phase refrigerant containing a large amount of the high-boiling-point refrigerant is stored in the accumulator 6. On the other hand, the gas-phase refrigerant containing a large amount of the low-boiling-point refrigerant flows out of the accumulator 6. Since the liquid-phase refrigerant containing a large amount of the high-boiling-point refrigerant is present within the accumulator 6 as described above, the composition of the low-boiling-point refrigerant relative to the entire refrigerant circulating through the refrigeration cycle is increased.

It should be noted that a fact that the composition of the low-boiling-point refrigerant relative to the entire refrigerant circulating through the refrigeration cycle may be decreased, will be described. For example, in the case where a refrigerating and air-conditioning apparatus includes a plurality of indoor units and these indoor units perform a heating operation, when some of the indoor units stop the heating operation within a short period of time, a liquid refrigerant may stay in the indoor units. Thus, the composition of the low-boiling-point refrigerant relative to the entire refrigerant circulating through the refrigeration cycle is decreased by the amount of the staying liquid refrigerant.

(2) When refrigerant leak occurs from a lower portion within the accumulator 6, the liquid-phase refrigerant stored in the lower portion of the accumulator 6 leaks. Since the liquid-phase refrigerant contains a large amount of the high-boiling-point refrigerant, the composition of the low-boiling-point refrigerant relative to the entire refrigerant circulating through the refrigeration cycle is increased in this case.

(3) When refrigerant leak occurs at a refrigerant pipe, as with the refrigerant pipe connecting the condenser 3 to the pressure reducing mechanism 4, through which a liquid single-phase refrigerant flows a large amount of the low-boiling-point refrigerant leaks since the low-boiling-point refrigerant is more likely to gasify. Thus, the composition of the high-boiling-point refrigerant relative to the entire refrigerant circulating through the refrigeration cycle is increased.

It should be noted that there is also a possibility that the liquid refrigerant leaks depending on a manner of refrigerant leak; and when no liquid refrigerant is present within the accumulator 6, the refrigerant composition does not change.

Next, the formulas used when the composition detection means 20 of the refrigerating and air-conditioning apparatus 100 according to Embodiment 1 calculates a refrigerant composition will be described. Here, where the pressure of the refrigerant at the suction side of the compressor 2 is Ps, the temperature of the refrigerant at the suction side of the compressor 2 is Ts, the pressure of the refrigerant at the discharge side of the compressor 2 is Pd, the rotation speed of the compressor 2 is N, the refrigerant composition of the low-boiling-point refrigerant relative to the entire refrigerant is α the stroke volume of the compressor 2 is Vst, the refrigerant density of the refrigerant at the suction side of the compressor 2 is ρs, the entropy of the refrigerant at the suction side of the compressor 2 is Ss, an enthalpy difference between before and after the refrigerant is compressed by the compressor 2 is Δh, the compressor efficiency of the compressor 2 is ηc, the volume efficiency of the compressor 2 is ηv, an amount of the circulating refrigerant is Gr, and the power consumption of the compressor 2 is W, the following formulas are established.

$$Gr=\rho_s\cdot\eta_v\cdot Vst\cdot N \quad \text{[Math. 1]}$$

$$W=Gr\cdot\Delta h/\eta c \quad \text{[Math. 2]}$$

Where:

$$\rho_s\rho_{PT\alpha}(P_s,T_s,\alpha) \quad \text{[Math. 3]}$$

$$\eta_v=f_1(P_d,P_s,T_s,N,\alpha) \quad \text{[Math. 4]}$$

$$\Delta=h_d^{ideal}-h_s=h_{PS\alpha}(P_d,S_s,\alpha)-h_{PT\alpha}(P_s,T_s,\alpha) \quad \text{[Math. 5]}$$

$$S_s=S_{PT\alpha}(P_s,T_s,\alpha) \quad \text{[Math. 6]}$$

$$\eta_0=f_2(P_d,P_s,T_s,N,\alpha) \quad \text{[Math. 7]}$$

Here, when solving for the compressor power consumption W by formulas 1 to 7, the following is obtained.

$$W=(\rho_s\cdot\Delta h)\times(N\cdot Vst\cdot\eta_v/\eta_0) \quad \text{[Math. 8]}$$

Here, formulas 1 and 2 are definitional equations of the volume efficiency ηv and the compressor efficiency ηc, respectively. Formulas 3, 5, and 6 are functions determined by pressure, temperature, refrigerant composition, and entropy, Specifically, formula 3 is a function of pressure, temperature, and refrigerant composition. In addition, the first term of formula 5 is a function of pressure, entropy, and refrigerant composition, and the second term of formula 5 is a function of pressure, temperature, and refrigerant composition. Furthermore, formula 6 is a function of pressure, temperature, and refrigerant composition.

Formulas 4 and 7 are indexes for the performance of the compressor 2 and are expansions of formula 1, which is the definitional equation of the volume efficiency ηv, and formula 2, which is the definitional equation of the compressor efficiency ηc, respectively. Then, unit evaluation of the compressor 2 is conducted under a plurality of conditions, and the unit evaluation result and the expansion of the volume efficiency ηv described above and the expansion of the compressor efficiency ηc are curve-fitted to set various constants in each expansion. It should be noted that the volume efficiency ηv and the compressor efficiency ηc may be obtained by conducting prediction through simulation if its accuracy is high. In addition, the unit evaluation of the above-described compressor 2 and the simulation may be used in combination. In other words, the number of tests for unit evaluation described above is reduced, and the volume efficiency ηv and the compressor efficiency ηc are obtained by interpolating and extrapolating the obtained result through the simulation.

The power consumption W of the compressor 2 is represented by formula 8. Specifically, the term described in the first parenthesis is a term corresponding to refrigerant physical properties calculated from an operating state of the refrigerating and air-conditioning apparatus 100, and the term described in the next parenthesis is a term corresponding to compressor characteristics calculated from an operating state of the refrigerating and air-conditioning apparatus 100. It should be noted that the refrigerant physical properties are the refrigerant density ρs and the enthalpy difference Δh in the compression process. In addition, the compressor characteristics are the rotation speed N of the compressor 2, the stroke volume Vst of the compressor 2, the volume efficiency ηv, and the compressor efficiency ηc. It should be noted that the stroke volume Vst of the compressor 2 is specific to the compressor 2 and is a known numerical value.

In detecting a refrigerant composition, the composition detection means 20 performs various calculations of formulas 3 to 8, the arguments described in formulas 1 to 8 are not essential, and an argument having low sensitivity may be omitted if no problem arises. For example, as shown in formula 3, when the sensitivity of he refrigerant density ρs is low, the refrigerant density ρs in formula 8 may be a constant.

In the refrigerating and air-conditioning apparatus 100 according to Embodiment 1, the composition detection means 20 calculates power consumption W of the compressor 2 on the basis of formula 8 thus obtained, and calculates a refrigerant composition on the basis of the calculated power consumption and a detection result of the output detection means 15. For a specific example of the method for calculating a refrigerant composition, refer to a description of FIG. 6 described later.

Figure 2:
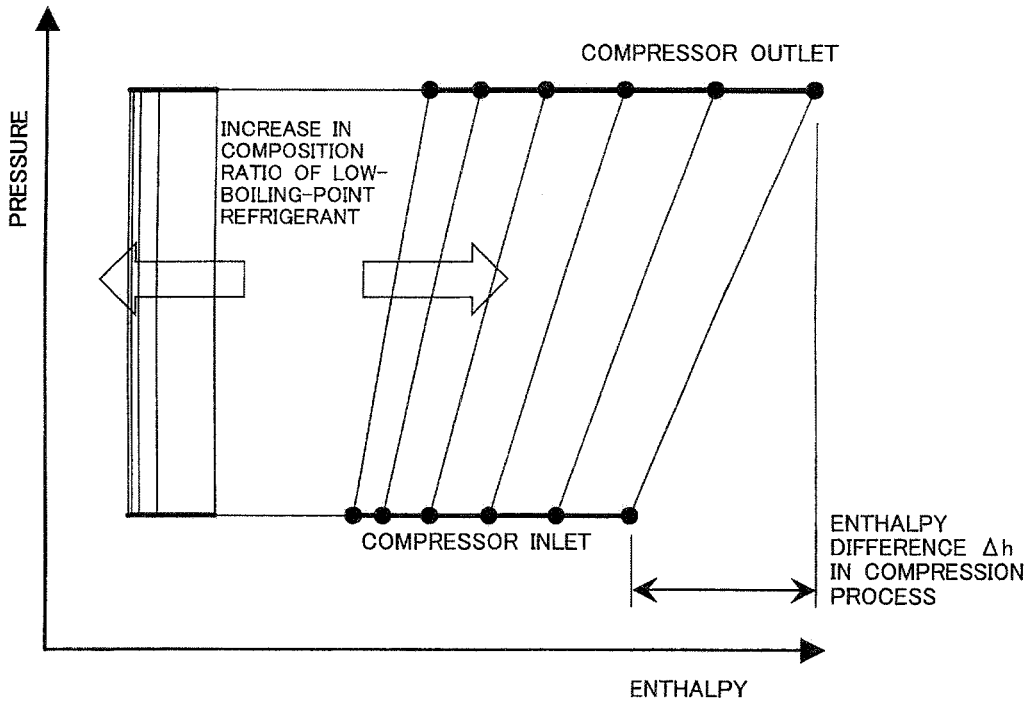
FIG. 2 is a Mollier diagram illustrating a state change in a compression process by a compressor when a refrigerant composition ratio of a low-boiling-point refrigerant is changed.
Figure 3:
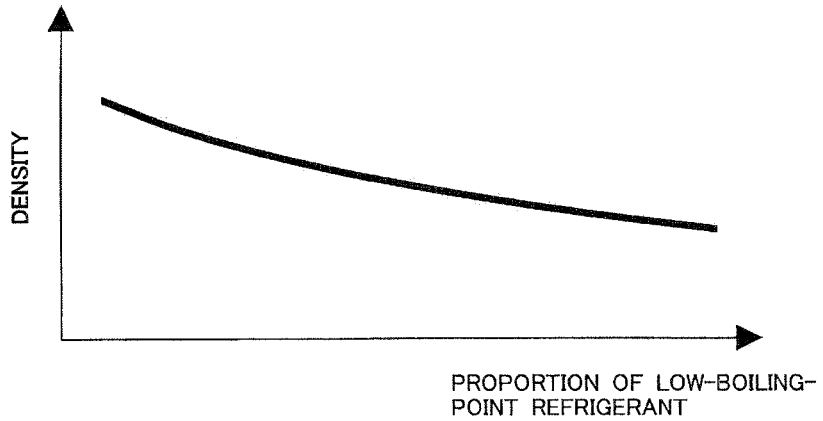
FIG. 3 is a graph illustrating a relationship between a proportion of the low-boiling-point refrigerant included in a circulating refrigerant and a refrigerant density.
Figure 4:
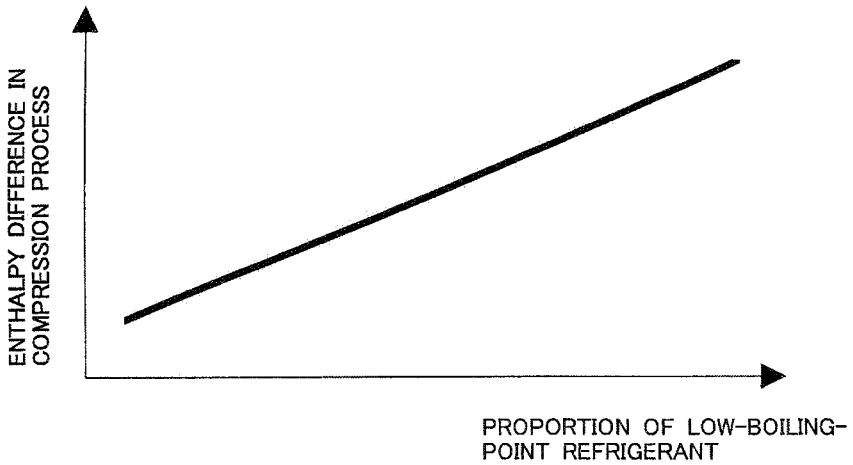
FIG. 4 is a graph illustrating a relationship between a proportion of the low-boiling-point refrigerant including in a circulating refrigerant and an enthalpy difference in a compression process by the compressor (before and after compression).
Figure 5:
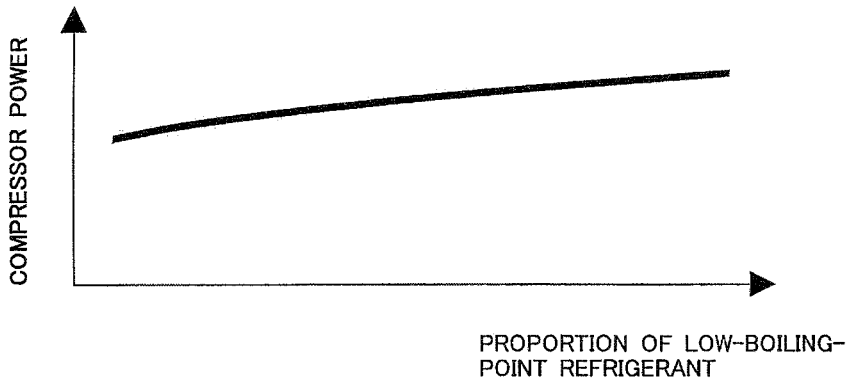
FIG. 5 is a graph illustrating a relationship between a proportion of the low-boiling-point refrigerant included in a circulating refrigerant and power consumption of the compressor.

FIG. 2 is a Mollier diagram illustrating a state change in the compression process by the compressor 2 when the refrigerant composition ratio of the low-boiling-point refrigerant is changed. FIG. 3 is a graph illustrating a relationship between the proportion of the low-boiling-point refrigerant included in the circulating refrigerant and the refrigerant density. FIG. 4 is a graph illustrating a relationship between the proportion of the low-boiling-point refrigerant included in the circulating refrigerant and an enthalpy difference in the compression process by the compressor 2 (before and after compression). FIG. 5 is a graph illustrating a relationship between the proportion of the low-boiling-point refrigerant included in the circulating refrigerant and the power consumption of the compressor 2. With reference to FIGS. 2 to 5, the Mollier diagram (FIG. 2) when the proportion of the low-boiling-point refrigerant (the composition ratio of the low-boiling-point refrigerant) is changed, the refrigerant density ρs (FIG. 3), the enthalpy difference Δh in the compression process (FIG. 4), and the power consumption W of the compressor 2 (FIG. 5) will be described.

It should be noted that in FIGS. 2 to 5, the pressure of the refrigerant at the suction side of the compressor 2, the pressure of the refrigerant at the discharge side of the compressor 2, subcooling at the outlet of the condenser 3, and superheat at the outlet of the evaporator 5 are fixed, and the composition of the circulating refrigerant is changed. The reason why the pressure of the refrigerant at the suction side of the compressor 2 and the pressure of the refrigerant at the discharge side of the compressor 2 are fixed is to observe how the difference in refrigerant composition affects on the Mollier diagram (FIG. 2), the refrigerant density ρs (FIG. 3), the enthalpy difference Δh in the compression process (FIG. 4), and the power consumption W of the compressor 2 (FIG. 5). In addition, results shown in FIGS. 2 to 5 indicate the similar tendency even when the temperature at the outlet of the condenser 3 is used instead of the subcooling at the outlet of the condenser 3 and the temperature at the outlet of the evaporator 5 is used instead of the superheat at the outlet of the evaporator 5.

As shown in FIG. 2, as the composition ratio of the low-boiling-point refrigerant, that is, the proportion of the low-boiling-point refrigerant, increases, the compression process shifts to a high enthalpy side (the right side of the sheet surface) and the gradient in the compression process increases. In addition, as shown in FIG. 3, as the proportion of the low-boiling-point refrigerant increases, the refrigerant density ρs monotonously decreases. Moreover, as shown in FIG. 4, as the proportion of the low-boiling-point refrigerant increases, the enthalpy difference Δh in the compression process increases. Therefore, as shown in FIG. 5, the power consumption W of the compressor 2 monotonously increases.

In other words, monotonous increase in the power consumption W of the compressor 2 in FIG. 5 is understandable, by making the fact that the degree of the increase of the enthalpy difference Δh in the compression process shown in FIG. 4 surpasses the degree of the decrease of the refrigerant density ρs shown in FIG. 3 correspond to formula 8.

In addition, in FIG. 5, the proportion of the refrigerant composition and the power consumption W of the compressor 2 have a simple correspondence relationship. The simple correspondence relationship suffices to be, for example, a one-to-one relationship such a linear line or a curve close to a linear line. Therefore, the composition detection means 20 of the refrigerating and air-conditioning apparatus 100 according to Embodiment 1 is able to assuredly detect a refrigerant composition.

Figure 7:
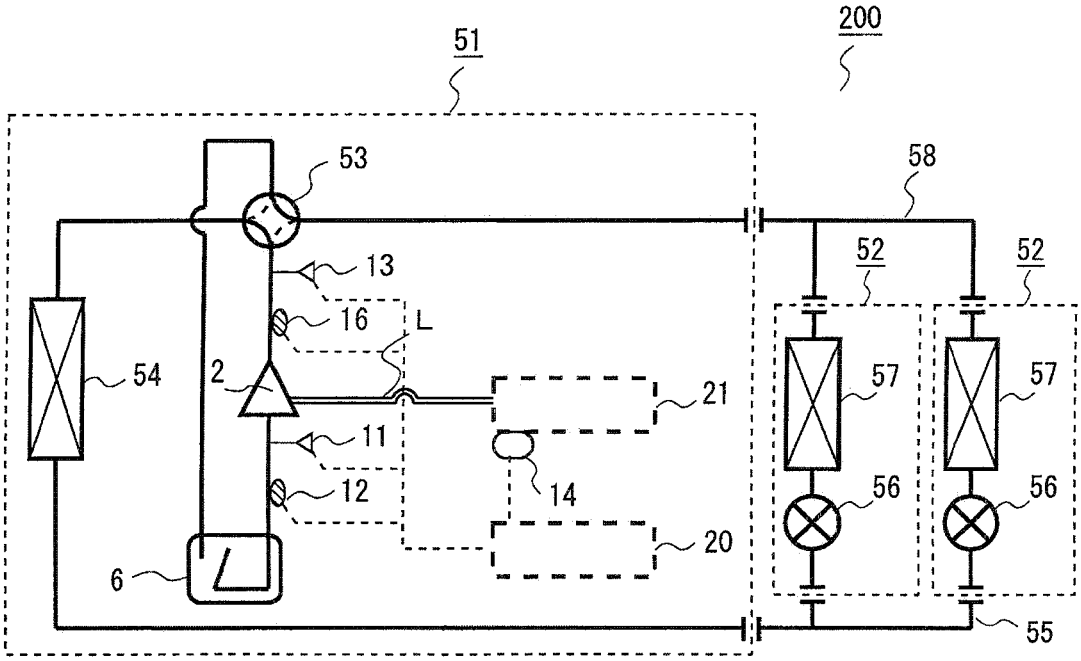
FIG. 7 shows an example of a refrigerant circuit configuration of a refrigerating and air-conditioning apparatus according to Embodiment 2 of the present invention.

In addition, changes in the volume efficiency ηv and the compressor efficiency ηc in response to a change in the proportion of the low-boiling-point refrigerant will be described. As shown in FIGS. 4 and 7, the volume efficiency ηv and the compressor efficiency ηc are certainly affected by a change in the proportion of the low-boiling-point refrigerant (a change in the refrigerant composition), however, the eventual extent of effects the change is having is rather limited.

For example, in a low pressure shell type compressor which comes into a compression process after a motor is cooled within the compressor 2, the volume efficiency ηv decreases as the refrigerant density ρs decreases. However, the refrigerant density ρs itself does not change much, and thus a change in the volume efficiency ηv does not affect the power consumption W of the compressor 2.

In addition, for example, in a scroll type compressor, the compressor efficiency ηc tends to have a peak at a proper compression ratio dependent on a fixed compression volume ratio. When the low-boiling-point refrigerant having a high density increases, the density ratio between the refrigerant at the suction side of the compressor and the refrigerant at the discharge side of the compressor changes. Thus, even when the compression volume ratio is fixed, the proper compression ratio changes. However, the degree of a change in the density ratio is as small as that of the refrigerant density ρs, and thus a change in the compressor efficiency ηc does not affect the power consumption W of the compressor.

Here, as shown in FIG. 2, when the composition of the circulating refrigerant changes, the enthalpy changes even there is no change in the pressure, and thus the performance of the refrigerating and air-conditioning apparatus 100 changes. In order for the refrigerating and air-conditioning apparatus 100 to exert a required level of performance, it is necessary to accurately detect the composition of the circulating refrigerant and perform operation control. In other words, the refrigerating and air-conditioning apparatus 100 according to Embodiment 1 performs refrigerant composition detection control described below, detects the composition of the circulating refrigerant with high accuracy, and uses the detection result for operation control.

Figure 6:
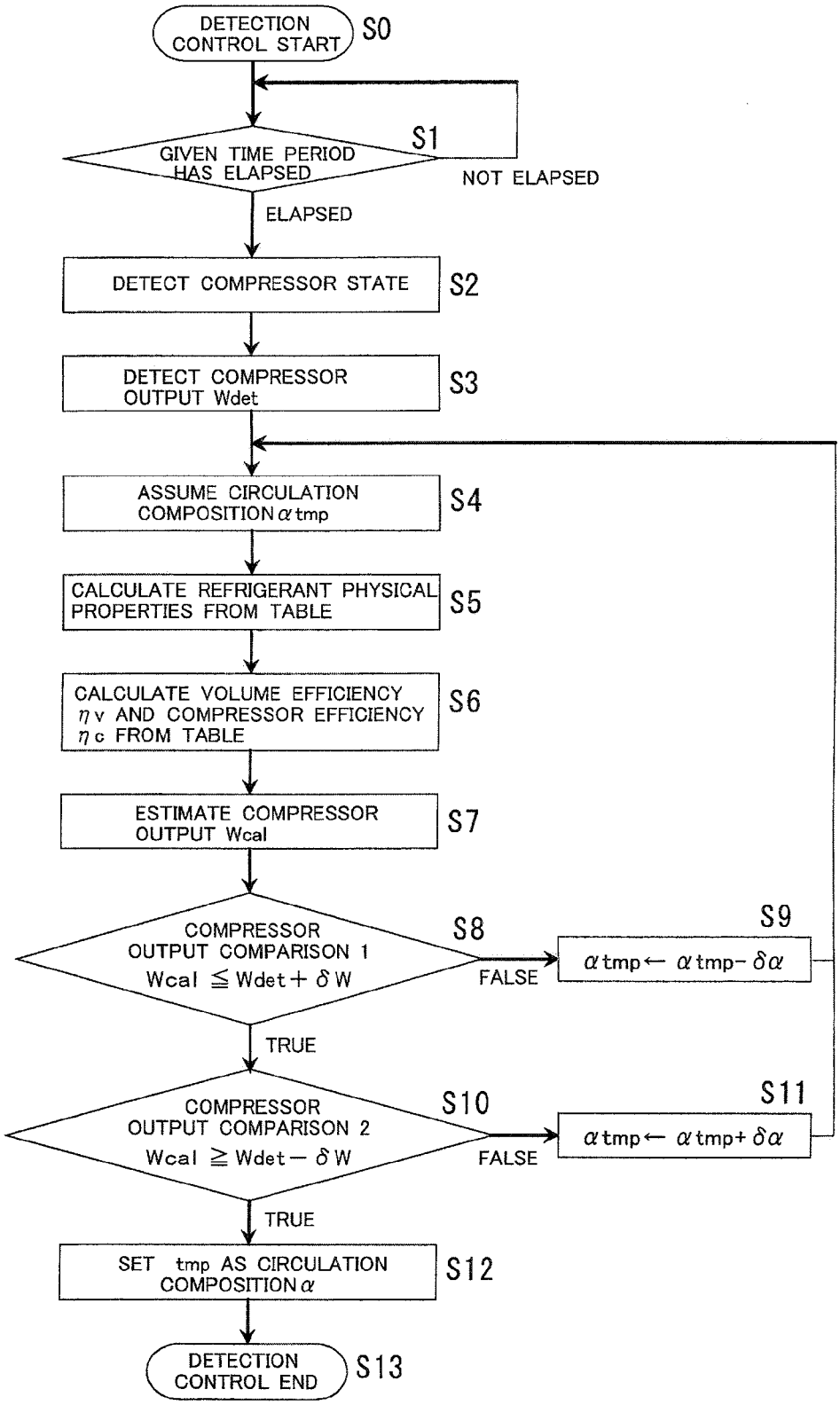
FIG. 6 is a flowchart illustrating control for detecting a refrigerant composition in the refrigerating and air-conditioning apparatus according to Embodiment 1 of the present invention.

FIG. 6 is a flowchart illustrating control for detecting a refrigerant composition in the refrigerating and air-conditioning apparatus 100 according to Embodiment 1 of the present invention. With reference to FIG. 6, an example of control for detecting a refrigerant composition (refrigerant composition detection control) will be described.

(Step S0)

A request signal for refrigerant composition detection control from the controller 21 is received by the composition detection means 20, and the composition detection means 20 starts refrigerant composition detection control. Then, the processing proceeds to step S1.

(Step S1)

The composition detection means 20 determines whether a given time period has elapsed.

When the given time period has elapsed, the processing proceeds to step S2.

When the given time period has not elapsed, step S1 is repeated.

It should be noted that setting a different time interval for other control in the controller 21 from the given time period eliminates interference and stabilizes the controllability. Thus, for example, the given time period may be set as a short cycle such as 10 sec or 20 sec.

(Step S2)

The suction-side pressure detection means 11 detects the pressure of the refrigerant at the suction side of the compressor 2, the suction-side temperature detection means 12 detects the temperature of the refrigerant at the suction side of the compressor 2, the discharge-side pressure detection means 13 detects the pressure of the refrigerant at the discharge side of the compressor 2, and the rotation speed detection means 14 detects the rotation speed of the compressor 2. Then, the processing proceeds to step S3.

(Step S3)

The output detection means 15 detects power consumption Wdet as an output of the compressor 2. Then, the processing proceeds to step S4.

(Step S4)

Where the composition of the low-boiling-point refrigerant circulating through the refrigeration cycle is α, the composition detection means 20 assumes and sets the value of the refrigerant composition α as αtmp. Then, the processing proceeds to step S5.

It should be noted that the refrigerant composition α in the last refrigerant composition detection control may be set as a set value of αtmp in entering a loop of steps S4 to S11 for the first time. Thus, the number of loops required for convergence in steps S4 to S11 is reduced, and thereby stabilizing the controllability.

(Step S5)

The composition detection means 20 calculates refrigerant physical properties. Specifically, the composition detection means 20 calculates the refrigerant density ρs of the refrigerant at the suction side of the compressor 2, the enthalpy difference Δh in the compression process, and the entropy Ss of the refrigerant at the suction side of the compressor 2 on the basis of the detection results (Ps, Ts, Pt) of the suction-side pressure detection means 11, the suction-side temperature detection means 12, and the discharge-side pressure detection means 13 in step S2, αtmp set in step S4, and formulas 3, 5, and 6. Then, the processing proceeds to step S6.

(Step S6)

The composition detection means 20 calculates compressor characteristics. Specifically, the composition detection means 20 calculates the volume efficiency ηv and the compressor efficiency ηc on the basis of the detection results (Ps, Ts, Pd, N) of the suction-side pressure detection means 11, the suction-side temperature detection means 12, the discharge-side pressure detection means 13, and the rotation speed detection means 14 in step S2, the detection result Wdet of the output detection means 15 in step S3, αtmp set in step S4, and formula 4 for the volume efficiency ηv and formula 7 for the compressor efficiency ηc which are obtained by curve-fitting the unit evaluation result of the compressor 2. Then, the processing proceeds to step S7.

It should be noted that curve fitting the unit evaluation result of the compressor 2 specifies as follows; only the compressor 2 is subjected to an evaluation conducted under a plurality of conditions, and curve-fit the compressor efficiency ηc obtained from the evaluation result to the expansion formula for the compressor efficiency ηc to determine various constants in the expansion formula.

(Step S7)

The composition detection means 20 calculates power consumption Wcal of the compressor 2 on the basis of the detection result (Wdet) of the output detection means 15 in step S3, the refrigerant density ρs of the refrigerant at the suction side of the compressor 2 and the enthalpy difference Δh in the compression process which are calculated in step S5, the preset stroke volume Vst, the volume efficiency ηv and the compressor efficiency ηc which are calculated in step S6, and formula 8. Then, the processing proceeds to step S8.

(Step S8)

The composition detection means 20 determines whether the power consumption Wcal calculated in step S7 is equal to or less than Wdet+δW which is a restricted upper limit.

If the power consumption Weal is equal to or less than Wdet+δW which is the restricted upper limit, the processing proceeds to step S10.

If the power consumption Wcal is not equal to or less than Wdet+δW which is the restricted upper limit, the processing proceeds to step S9.

It should be noted that δW (>0) is an allowable error. In addition, δW may be a fixed value, or may be changed on the basis of the difference between Wcal and Wdet+δW.

(Step S9)

The composition detection means 20 sets, as αtmp, a value obtained by subtracting a predetermined value δα from αtmp set in step S4. Then, the processing proceeds to step S4.

It should be noted that δα may be a fixed value, or may be changed on the basis of the difference between Wcal and Wdet+δW.

(Step S10)

The composition detection means 20 determines whether the power consumption Wcal calculated in step S7 is equal to or greater than Wdet−δW which is a restricted lower limit.

If the power consumption Wcal is equal to or greater than Wdet−δW which is the restricted lower limit, the processing proceeds to step S12.

If the power consumption Wcal is not equal to or greater than Wdet−δW which is the restricted lower limit, the processing proceeds to step S11.

It should be noted that δW (>0) is an allowable error. In addition, δW may be a fixed value, or may be changed on the basis of the difference between Wcal and Wdet−δW.

(Step S11)

The composition detection means 20 set, as αtmp, a value obtained by adding a predetermined value δα to αtmp set in step S4. Then, the processing proceeds to step S4.

It should be noted that δα may be a fixed value, or may be changed on the basis of the difference between Weal and Wdet−δW.

(Step S12)

The composition detection means 20 sets αtmp as a composition α of the refrigerant circulating through the refrigeration cycle. Then, the processing proceeds to step S13.

(Step S13)

The composition detection means 20 ends the control for detecting the refrigerant composition.

Here, steps S5 to S8 are a process calculating the power consumption of the compressor 2 from the operating state of the compressor 2. However, steps S5 to S8 may be integrated into a single step by assuming all operating states and calculating and tabling the power consumption of the compressor 2.

It should be noted that in Embodiment 1, R32 and R1234yf are used as the non-azeotropic refrigerant mixture, but another low-boiling-point refrigerant and another high-boiling-point refrigerant may be used. For example, a hydrofluoroolefin-based refrigerant having double bonds may be used, a low flammable refrigerant may be used, or a flammable HC-based refrigerant may be used.

In addition, the non-azeotropic refrigerant mixture is composed of a mixture of two refrigerants, but may be composed of a mixture of three or more refrigerants. In the case of three or more refrigerants, for example, refrigerant compositions of the other refrigerants (composition relationship formula) relative to a refrigerant whose refrigerant composition is calculated may be calculated previously by an experiment, simulation, or the like. Thus, when the refrigerant composition of one refrigerant is calculated as in the refrigerating and air-conditioning apparatus 100 according to Embodiment 1, it is also possible to calculate the other refrigerant compositions.

In addition, the refrigerating and air-conditioning apparatus 100 according to Embodiment 1 uses the power consumption of the compressor as an output of the compressor 2. Here, the connection position of the output detection means 15 may be a primary-side input including inverter loss, or may be a secondary-side input-output not including inverter loss. In calculating formula 7 or 4, when unit evaluation, simulation, or the like of the compressor 2 is conducted, a condition regarding the connection position of the output detection means 15 may be adjusted.

In addition, the power consumption of the compressor 2 is used as the output detected by the output detection means 15, but a current of the compressor 2 may be used. The power consumption of the compressor 2 is defined as a product of a voltage, a current, and a power factor, and it has been confirmed in a real machine that the power consumption and the current have a one-to-one correlation under the same operating state of the compressor 2.

Thus, it means that when the composition detection means 20 is enabled to calculate power consumption corresponding to a detected current, the output detection means 15 may be one (a current sensor) that detects the current of the compressor 2. In this case, when the output detection means 15 is commonalized with one installed for the reason such as overcurrent protection, it is possible to reduce the cost.

The refrigerating and air-conditioning apparatus 100 according to Embodiment 1 detects a refrigerant composition through a control flow as in steps S0 to S13. In other words, the refrigerating and air-conditioning apparatus 100 detects the composition of the refrigerant in accordance with a simple relationship between the refrigerant composition and the power consumption of the compressor 2. Thus, the refrigerating and air-conditioning apparatus 100 is able to detect the composition with high accuracy even when the composition of the circulating refrigerant is changed due to the operating condition.

In addition, the refrigerating and air-conditioning apparatus 100 detects a refrigerant composition on the basis of the pressure and the temperature of the refrigerant at the suction side of the compressor 2 and the pressure of the refrigerant at the discharge side of the compressor 2. In other words, once the specifications of the compressor 2 are determined, the refrigerating and air-conditioning apparatus 100 realizes the control for detecting the refrigerant composition, and does not depend on the specifications of the refrigerating and air-conditioning apparatus 100. Thus, the necessity to grasp a refrigerant composition change for each specification of the refrigerating and air-conditioning apparatus 100 through real machine evaluation or simulation is eliminated, and the necessity to establish a control flow for detecting a refrigerant composition for each refrigerating and air-conditioning apparatus 100 is eliminated as well. Therefore, the load and the cost of development are reduced.

Furthermore, as shown in FIG. 2, the refrigerating and air-conditioning apparatus 100 according to Embodiment 1 does not perform composition detection at a branched refrigerant path. In other words, the refrigerating and air-conditioning apparatus 100 performs composition detection at a single path of the compression process, and hence enables composition detection even in a gas-liquid two-phase state. Thus, the compressor 2 of the refrigerating and air-conditioning apparatus 100 is restrained from being damaged, and hence it is possible to suppress reduction of the reliability.

In addition, the refrigerating and air-conditioning apparatus 100 according to Embodiment 1 detects a refrigerant composition with the components such as the suction-side pressure detection means 11, the suction-side temperature detection means 12, the discharge-side pressure detection means 13, the rotation speed detection means 14, and the output detection means 15. In other words, the refrigerating and air-conditioning apparatus 100 does not use expensive components such as a bypass composed of a heat exchanger, an expansion mechanism, and the like and a liquid level detector of an accumulator, and thus the detection of refrigerant composition is able to be performed at low cost.

Embodiment 2

FIG. 7 shows an example of a refrigerant circuit configuration of a refrigerating and air-conditioning apparatus 200 according to Embodiment 2 of the present invention. In addition, in Embodiment 2, the same parts as those in Embodiment 1 are denoted by the same reference characters, and the difference from Embodiment 1 will be mainly described.

In Embodiment 1, the unit evaluation of the compressor 2 is conducted under a plurality of conditions, and the unit evaluation result and the expansion formula for the compressor efficiency $\eta c$ are curve-fitted to each other to determine various constants in the expansion formula for $\eta v$. In other words, whereas the composition detection means 20 of the refrigerating and air-conditioning apparatus 100 according to Embodiment 1 performs unit evaluation and calculation such as curve fitting for calculating $\eta v$ and calculates the refrigerant composition $\alpha$, the composition detection means 20 of the refrigerating apparatus 200 according to Embodiment 2 calculates the refrigerant composition $\alpha$ without using formula 4. Thus, it is possible to reduce the load of development, reduce the load of a storage device, and improve the arithmetic processing speed.

In the refrigerating and air-conditioning apparatus 200 according to Embodiment 2, an outdoor unit 51 including an accumulator 6, a compressor 2, a four-way valve 53, an outdoor heat exchanger 54, etc. and indoor units 52 each including an indoor heat exchanger 57 and a pressure reducing mechanism 56 are connected to each other via a liquid extension pipe 55 and a gas extension pipe 58 to form a refrigeration cycle. It should be noted that FIG. 7 illustrates an example where the refrigerating and air-conditioning apparatus 200 includes two indoor units 52, but the present invention is not limited thereto, and the refrigerating and air-conditioning apparatus 200 may include three or more indoor units 52.

The outdoor unit 51 includes the compressor 2 which compresses a refrigerant, the four-way valve 53 which switches a refrigerant flow path, the outdoor heat exchanger 54 which serves as a condenser during a cooling operation and as an evaporator during a heating operation, and the accumulator 6 which stores an excess refrigerant.

In addition, the outdoor unit 51 includes the suction-side pressure detection means 11, the suction-side temperature detection means 12, the discharge-side pressure detection means 13, and the rotation speed detection means 14 which are described in Embodiment 1. In addition to these detection means 11 to 14, the outdoor unit 51 includes discharge-side temperature detection means 16 which detects the temperature of the refrigerant discharged from the compressor 2. It should be noted that the outdoor unit 51 does not include the output detection means 15 described in Embodiment 1.

Furthermore, the outdoor unit 51 includes composition detection means 20 which detects a refrigerant composition on the basis of detection results of these detection means 11 to 14 and 16; and a controller 21 which integrally controls the rotation speed of the compressor 2 and various devices.

Each indoor unit 52 includes the indoor heat exchanger 57 which serves as an evaporator during a cooling operation and as a condenser during a heating operation; and the pressure reducing mechanism 56 which reduces the pressure of the refrigerant to expand the refrigerant.

The liquid extension pipe 55 and the gas extension pipe 58 are pipes connecting the outdoor unit 51 to the indoor units 52. The liquid extension pipe 55 is connected at one end to the outdoor heat exchanger 54 and connected another end to each pressure reducing mechanism 56. In addition, the gas extension pipe 58 is connected at one end to the four-way valve 53 and connected at another end to each indoor heat exchanger 57.

The four-way valve 53 switches the refrigerant flow path. The four-way valve 53 is switched to connect the compressor 2 to the outdoor heat exchanger 54 and connect the accumulator 6 to each indoor heat exchanger 57 during a cooling operation, and is switched to connected the compressor 2 to each indoor heat exchanger 57 and connect the outdoor heat exchanger 54 to the accumulator 6 during a heating operation.

The discharge-side temperature detection means 16 (constituting operating state detection means) detects the temperature of the refrigerant discharged from the compressor 2 (high-pressure-side refrigerant pressure). In addition, the discharge-side temperature detection means 16 is connected to the composition detection means 20. Here, FIG. 7 illustrates an example where the discharge-side temperature detection means 16 is installed on a refrigerant pipe connecting the accumulator 6 to the compressor 2, but the present invention is not limited thereto. In other words, the discharge-side temperature detection means 16 may be installed within the compressor 2 and at a position after the refrigerant is compressed (a position after a compression process). Thus, it is possible to detect a refrigerant composition with high accuracy.

It should be noted that when, similarly to the suction-side temperature detection means 12, installing the discharge-side temperature detection means 16 within the compressor 2 and at the position before the refrigerant is compressed also suppresses such disturbance, and it is therefore possible to detect a refrigerant composition with high accuracy.

The composition detection means 20 has stored therein a function described in formula 9, in addition to the functions described in formulas 5 to 7 described in Embodiment 1. The composition detection means 20 is able to calculate the temperature of the refrigerant at the discharge side of the compressor 2 on the basis of detection results of the suction-side pressure detection means 11, the suction-side temperature detection means 12, the discharge-side pressure detection means 13, and the rotation speed detection means 14, the above formulas 5 to 7, and formula 9. The composition detection means 20 calculates a refrigerant composition on the basis of the calculated refrigerant temperature and a detection result of the discharge-side temperature detection means 16.

Next, the formulas used when the composition detection means 20 of the refrigerating and air-conditioning apparatus 200 according to Embodiment 2 calculates a refrigerant composition will be described. Here, where the temperature of the refrigerant at the discharge side of the compressor 2 is T, formula 9 is obtained from formulas 5 to 7.

$$T \equiv T_{PH\alpha}(P_{ch}, \Delta h/\eta_c + h_s, \alpha) \quad \text{[Math. 9]}$$

That is, the composition detection means 20 of the refrigerating and air-conditioning apparatus 200 according to Embodiment 2 calculates the temperature T of the refrigerant at the discharge side of the compressor 2 on the basis of the detection results of the suction-side pressure detection means 11, the suction-side temperature detection means 12, the discharge-side pressure detection means 13, and the rotation speed detection means 14 and formula 9. The composition detection means 20 calculates a refrigerant composition on the basis of the calculated temperature T of the refrigerant at the discharge side and the detection result of the discharge-side temperature detection means 16. For a specific example of the method for calculating a refrigerant composition, refer to a description of FIG. 9 described later.

Figure 8:
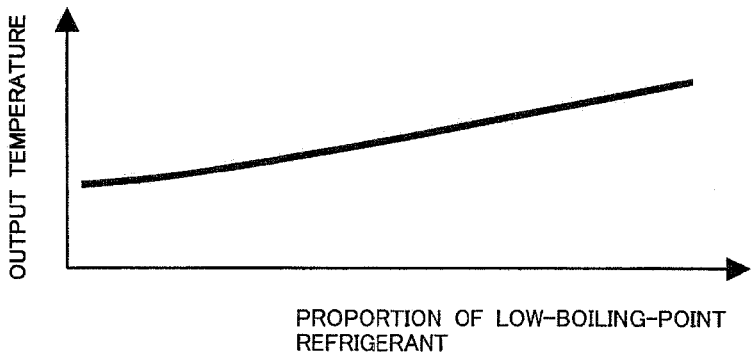
FIG. 8 is a graph illustrating a relationship between a proportion of a low-boiling-point refrigerant included in a circulating refrigerant and a temperature at a discharge side of a compressor.

FIG. 8 is a graph illustrating a relationship between the proportion of a low-boiling-point refrigerant included in the circulating refrigerant and the temperature at the discharge side of the compressor 2. With reference to FIG. 8, the temperature of the refrigerant at the discharge side of the compressor 2 when the proportion of the low-boiling-point refrigerant (the composition ratio of the low-boiling-point refrigerant) is changed will be described. It should be noted that in FIG. 8 as well, similarly to FIGS. 2 to 5 described above, the pressure of the refrigerant at the suction side of the compressor 2, the pressure of the refrigerant at the discharge side of the compressor 2, subcooling at the outlet of the condenser 3, and superheat at the outlet of the evaporator 5 are fixed, and the composition of the circulating refrigerant is changed.

As shown in FIG. 8, the temperature of the refrigerant at the discharge side of the compressor 2 monotonously increases. The proportion of the refrigerant composition and the temperature of the refrigerant at the discharge side of the compressor 2 have a simple correspondence relationship. Therefore, the composition detection means 20 of the refrigerating and air-conditioning apparatus 200 according to Embodiment 2 is able to assuredly detect a refrigerant composition.

Figure 9:
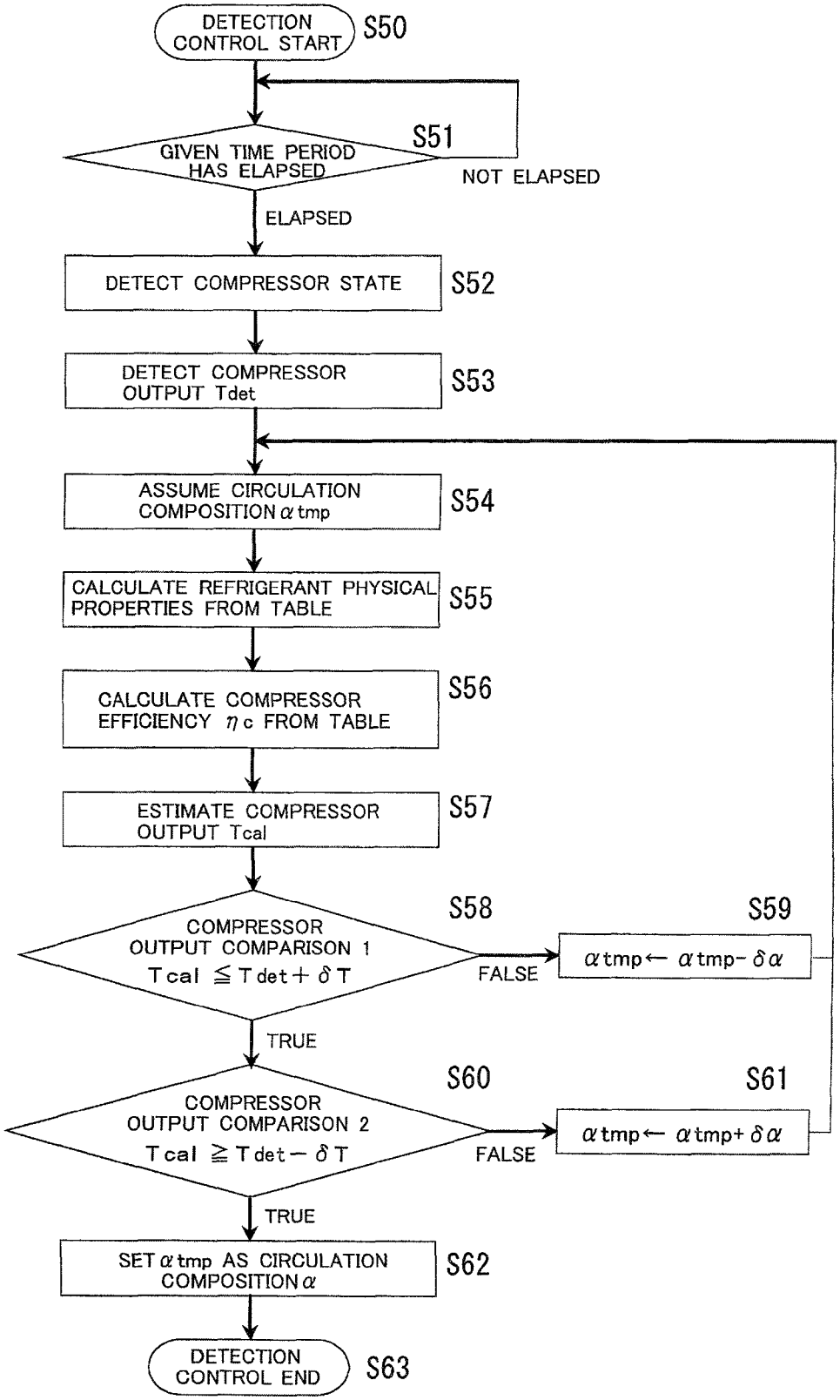
FIG. 9 is a flowchart illustrating control for detecting a refrigerant composition in the refrigerating and air-conditioning apparatus according to Embodiment 2 of the present invention.

FIG. 9 is a flowchart illustrating control for detecting a refrigerant composition in the refrigerating and air-conditioning apparatus 200 according to Embodiment 2 of the present invention. With reference to FIG. 9, a method for detecting a refrigerant composition will be described.

(Step S50)

A request signal for refrigerant composition detection control from the controller 21 is received by the composition detection means 20, and the composition detection means 20 starts refrigerant composition detection control. Then, the processing proceeds to step S51.

(Step S51)

The composition detection means 20 determines whether a given time period has elapsed, When the given time period has elapsed, the processing proceeds to step S52.

When the given time period has not elapsed, step S51 is repeated.

It should be noted that setting a different time interval for other control in the controller 21 from the given time period eliminates interference and stabilizes the controllability. Thus, for example, the given time period may be set as a short cycle such as 10 sec or 20 sec.

(Step S52)

The suction-side pressure detection means 11 detects the pressure of the refrigerant at the suction side of the compressor 2, the suction-side temperature detection means 12 detects the temperature of the refrigerant at the suction side of the compressor 2, the discharge-side pressure detection means 13 detects the pressure of the refrigerant at the discharge side of the compressor 2, and the rotation speed detection means 14 detects the rotation speed of the compressor 2. Then, the processing proceeds to step S53.

(Step S53)

The discharge-side temperature detection means 16 detects a temperature Tdet of the refrigerant at the discharge side of the compressor 2. Then, the processing proceeds to step S54.

(Step S54)

Where the refrigerant composition of the low-boiling-point refrigerant circulating through the refrigeration cycle is α, the composition detection means 20 sets the value of the refrigerant composition α as αtmp. Then, the processing proceeds to step S55.

It should be noted that the refrigerant composition α in the last refrigerant composition detection control may be set as a set value of αtmp in entering a loop of steps S54 to S61 for the first time. Thus, the number of loops required for convergence in steps S54 to S61 is small, and it is possible to stabilize the controllability.

(Step S55)

The composition detection means 20 calculates refrigerant physical properties. Specifically, the composition detection means 20 calculates the entropy Ss of the refrigerant at the suction side of the compressor 2 and the enthalpy difference Δh in the compression process on the basis of the detection results (Ps, Ts, Td) of the suction-side pressure detection means 11, the suction-side temperature detection means 12, and the discharge-side pressure detection means 13 in step S2, αtmp set in step S54, and formulas 3, 5, and 6. Then, the processing proceeds to step S56.

(Step S56)

The composition detection means 20 calculates a compressor characteristic. Specifically, the composition detection means 20 calculates compressor efficiencyηc on the basis of the detection results (Ps, Ts, Pd, N) of the suction-side pressure detection means 11, the suction-side temperature detection means 12, the discharge-side pressure detection means 13, and the rotation speed detection means 14 in step S52, the detection result Tdet of the discharge-side temperature detection means 16 in step S53, αtmp set in step S54, and formula 7 for the compressor efficiency ηc which is obtained by curve-fitting the unit evaluation result of the compressor 2. Then, the processing proceeds to step S57.

(Step S57)

The composition detection means 20 calculates a temperature Tcal of the refrigerant at the discharge side of the compressor 2 on the basis of the detection result (Tdet) of the discharge-side temperature detection means 16 in step S53, the enthalpy difference Δh in the compression process which is calculated in step S55, the compressor efficiency ηc which is calculated in step S56, and formula 9. Then, the processing proceeds to step S58.

(Step S58)

The composition detection means 20 determines whether the temperature Tcal calculated in step S57 is equal to or less than Tdet+δT which is a restricted upper limit.

If the temperature Tcal is equal to or less than Tdet+δT which is the restricted upper limit, the processing proceeds to step S60.

If the temperature Tcal is not equal to or less than Tdet+δT which is the restricted upper limit, the processing proceeds to step S59.

It should be noted that δT (>0) is an allowable error. In addition, δT may be a fixed value, or may be changed on the basis of the difference between Tcal and Tdet+δT.

(Step S59)

The composition detection means 20 sets, as αtmp, a value obtained by subtracting a predetermined value δT from αtmp set in step S54. Then, the processing proceeds to step S54.

It should be noted that δT may be a fixed value, or may be changed on the basis of the difference between Tcal and Tdet+δT.

(Step S60)

The composition detection means 20 determines whether the temperature Tcal calculated in step S57 is equal to or greater than Tdet−δT which is a restricted lower limit.

If the temperature Tcal is equal to or greater than Tdet−δT which is the restricted lower limit, the processing proceeds to step S62.

If the temperature Tcal is not equal to or greater than Tdet−δT which is the restricted lower limit, the processing proceeds to step S61.

It should be noted that δT (>0) is an allowable error. In addition, δT may be a fixed value, or may be changed on the basis of the difference between Tcal and Tdet−δT.

(Step S61)

The composition detection means 20 sets, as αtmp, a value obtained by adding a predetermined value δT to αtmp set in step S54. Then, the processing proceeds to step S54.

It should be noted that δT may be a fixed value, or may be changed on the basis of the difference between Tcal and Tdet−δT.

(Step S62)

The composition detection means 20 sets αtmp as a composition α of the refrigerant circulating through the refrigeration cycle. Then, the processing proceeds to step S63.

(Step S63)

The composition detection means 20 ends the control for detecting the refrigerant composition.

The refrigerating and air-conditioning apparatus 200 according to Embodiment 2 detects a refrigerant composition through a control flow as in steps S50 to S63. In other words, the refrigerating and air-conditioning apparatus 200 detects the composition of the refrigerant in accordance with a simple relationship between the refrigerant composition and the temperature of the refrigerant at the discharge side of the compressor 2. Thus, the refrigerating and air-conditioning apparatus 200 is able to detect the composition with high accuracy even when the composition of the circulating refrigerant is changed depending on the operating condition.

In addition, the refrigerating and air-conditioning apparatus 200 detects a refrigerant composition on the basis of the pressure and the temperature of the refrigerant at the suction side of the compressor 2 and the temperature of the refrigerant at the discharge side of the compressor 2. In other words, in the refrigerating and air-conditioning apparatus 200, the control for detecting the refrigerant composition is capable of being realized when the specifications of the compressor 2 alone are determined, and does not depend on the specifications of the refrigerating and air-conditioning apparatus 200 (unit). Thus, it is not necessary to grasp a refrigerant composition change for each specification of the refrigerating and air-conditioning apparatus 200 through real machine evaluation or simulation, and it is not necessary to establish a control flow for detecting a refrigerant composition for each refrigerating and air-conditioning apparatus 200. Therefore, it is possible to reduce the load and the cost of development.

Furthermore, as shown in FIG. 1, the refrigerating and air-conditioning apparatus 100 according to Embodiment 1 does not perform composition detection at a branched refrigerant path. In other words, the refrigerating and air-conditioning apparatus 100 performs composition detection at a single path of the compression process, and hence enables composition detection even in a gas-liquid two-phase state. Thus, the compressor 2 of the refrigerating and air-conditioning apparatus 100 is restrained from being damaged, and hence it is possible to suppress reduction of the reliability.

In addition, the refrigerating and air-conditioning apparatus 200 according to Embodiment 2 detects a refrigerant composition with the components such as the suction-side pressure detection means 11, the suction-side temperature detection means 12, the discharge-side pressure detection means 13, the rotation speed detection means 14, and the output detection means 15. In other words, the refrigerating and air-conditioning apparatus 200 does not use expensive components such as a bypass composed of a heat exchanger, an expansion mechanism, and the like and a liquid level detector of an accumulator, and thus is able to detect a refrigerant composition at low cost.

REFERENCE SIGNS LIST

2 compressor, 3 condenser, 4 pressure reducing mechanism, 5 evaporator, 6 accumulator, 11 suction-side pressure detection means, 12 suction-side temperature detection means, 13 discharge-side pressure detection means, 14 rotation speed detection means, 15 output detection means, 16 discharge-side temperature detection means, 20 composition detection means, 21 control means, 51 outdoor unit, 52 indoor unit, 53 four-way valve, 54 outdoor heat exchanger, 55 liquid extension pipe, 56 pressure reducing mechanism, 57 indoor heat exchanger, 58 gas extension pipe, 100 refrigerating and air-conditioning apparatus, 200 refrigerating and air-conditioning apparatus, L power supply line

The invention claimed is:

1. A refrigerating and air-conditioning apparatus using an non-zeotropic refrigerant mixture as a refrigerant, the refrigerating and air-conditioning apparatus comprising:

a refrigerant cycle configured by a compressor, a condenser, an expansion device, and an evaporator connected by a refrigerant pipeline an operating state detection sensor configured to detect, as an operating state of the compressor, a pressure of the refrigerant at a suction side of the compressor, a pressure of the refrigerant at a discharge side of the compressor, a temperature of the refrigerant at the suction side of the compressor, and a rotation speed of the compressor, a power sensor configured to detect a first power consumption of the compressor, and a composition detection circuit that retains data indicating a one-to-one relationship between the first power consumption and a refrigerant composition, wherein the composition detection circuit is configured to tentatively set an assumed value of the refrigerant composition, calculate a second power consumption of the compressor based on the assumed value of the refrigerant composition and the pressure of the refrigerant at the suction side of the compressor, the pressure of the refrigerant at the discharge side of the compressor, the temperature of the refrigerant at the suction side of the compressor, and the rotation speed of the compressor detected by the operation state detection device, when the calculated second power consumption of the compressor is within a range predetermined based on the detected first power consumption of the compressor, set the assumed value of the refrigerant composition as the refrigerant composition, and when the calculated second power consumption of the compressor is beyond the range, set a value obtained by adding or subtracting a predetermined value $\delta\alpha$ from the assumed value of the refrigerant composition as the refrigerant composition and recalculate the second power consumption of the compressor.

2. The refrigerating and air-conditioning apparatus of claim 1, wherein the non-azeotropic refrigerant is composed of two or more refrigerant components, wherein a low-boiling-point refrigerant of the two or more refrigerant components is R32, and wherein a high-boiling-point refrigerant of the two or more refrigerant components is a hydrofluoroolefin-based flammable refrigerant.

3. The refrigerating and air-conditioning apparatus of claim 1, wherein the composition detection circuit:

calculates a density of the refrigerant at the suction side of the compressor, an entropy at the suction side of the compressor, an enthalpy at the suction side of the compressor, an enthalpy at the discharge side of the compressor and a compressor efficiency of the compressor on the basis of the detection result of the operating state detection sensor, and calculates the second power consumption of the compressor based on the calculated density of the refrigerant at the suction side of the compressor, the calculated entropy at the suction side of the compressor, the calculated enthalpy at the suction side of the compressor, the calculated enthalpy at the discharge side of the compressor and the calculated compressor efficiency of the compressor.

4. The refrigerating and air-conditioning apparatus of claim 1, wherein the refrigerant composition of the data indicating a one-to-one relationship between the first power consumption and the refrigerant composition in the composition detection circuit is a proportion of an R32 refrigerant to a hydrofluoroolefin-based flammable refrigerant.

5. A refrigerating and air-conditioning apparatus using an non-zeotropic refrigerant mixture as a refrigerant, the refrigerating and air-conditioning apparatus comprising:

a refrigerant cycle configured by a compressor, a condenser, an expansion device, and an evaporator connected by a refrigerant pipeline an operating state detection sensor configured to detect, as an operating state of the compressor, a pressure of the refrigerant at a suction side of the compressor, a pressure of the refrigerant at a discharge side of the compressor, a temperature of the refrigerant at the suction side of the compressor, and a rotation speed of the compressor, a current sensor configured to detect a first current of the compressor, and a composition detection circuit that retains data indicating a one-to-one relationship between the first current and a refrigerant composition, wherein the composition detection circuit is configured to tentatively set an assumed value of the refrigerant composition, calculate a second current of the compressor based on the assumed value of the refrigerant composition and the pressure of the refrigerant at the suction side of the compressor, the pressure of the refrigerant at the discharge side of the compressor, the temperature of the refrigerant at the suction side of the compressor, and the rotation speed of the compressor detected by the operation state detection device, when the calculated second current of the compressor is within a range predetermined based on the detected first current of the compressor, set the assumed value of the refrigerant composition as the refrigerant composition, and when the calculated second current of the compressor is beyond the range, set a value obtained by adding or subtracting a predetermined value δα from the assumed value of the refrigerant composition as the refrigerant composition and recalculate the second current of the compressor.

6. The refrigerating and air-conditioning apparatus of claim 5, wherein the composition detection circuit:

calculates a density of the refrigerant at the suction side of the compressor, an entropy at the suction side of the compressor, an enthalpy at the suction side of the compressor, an enthalpy at the discharge side of the compressor and a compressor efficiency of the compressor on the basis of the detection result of the operating state detection sensor, and calculates the second current based on the calculated density of the refrigerant at the suction side of the compressor, the calculated entropy at the suction side of the compressor, the calculated enthalpy at the suction side of the compressor, the calculated enthalpy at the discharge side of the compressor and the calculated compressor efficiency of the compressor.

7. The refrigerating and air-conditioning apparatus of claim 5, wherein the refrigerant composition of the data indicating a one-to-one relationship between the first power consumption and the refrigerant composition in the composition detection circuit is a proportion of an R32 refrigerant to a hydrofluoroolefin-based flammable refrigerant.

8. A refrigerating and air-conditioning apparatus using an non-zeotropic refrigerant mixture as a refrigerant, the refrigerating and air-conditioning apparatus comprising:

a refrigerant cycle configured by a compressor, a condenser, an expansion device, and an evaporator connected by a refrigerant pipeline an operating state detection sensor configured to detect, as an operating state of the compressor, a pressure of the refrigerant at a suction side of the compressor, a pressure of the refrigerant at a discharge side of the compressor, a temperature of the refrigerant at the suction side of the compressor, a first temperature of the refrigerant at the discharge side of the compressor, and a rotation speed of the compressor, and a composition detection circuit that retains data indicating a one-to-one relationship between the first current and a refrigerant composition, wherein the composition detection circuit is configured to tentatively set an assumed value of the refrigerant composition, calculate a second temperature of the refrigerant at the discharge side of the compressor based on the assumed value of the refrigerant composition and the pressure of the refrigerant at the suction side of the compressor, the pressure of the refrigerant at the discharge side of the compressor, the temperature of the refrigerant at the suction side of the compressor, and the rotation speed of the compressor detected by the operation state detection device, when the calculated second temperature is within a range predetermined based on the detected first temperature, set the assumed value of the refrigerant composition as the refrigerant composition, when the calculated second temperature is beyond the range, set a value obtained by adding or subtracting a predetermined value δα from the assumed value of the refrigerant composition as the refrigerant composition and recalculate the second temperature.

9. The refrigerating and air-conditioning apparatus of claim 8, wherein the composition detection circuit:

calculates a density of the refrigerant at the suction side of the compressor, an entropy at the suction side of the compressor, an enthalpy at the suction side of the compressor, an enthalpy at the discharge side of the compressor and a compressor efficiency of the compressor on the basis of the detection result of the operating state detection sensor, and calculates the second temperature of the refrigerant at the discharge side of the compressor based on the calculated density of the refrigerant at the suction side of the compressor, the calculated entropy at the suction side of the compressor, the calculated enthalpy at the suction side of the compressor, the calculated enthalpy at the discharge side of the compressor and the calculated compressor efficiency of the compressor.

10. The refrigerating and air-conditioning apparatus of claim 8, wherein the refrigerant composition of the data indicating a one-to-one relationship between the first power consumption and the refrigerant composition in the composition detection circuit is a proportion of an R32 refrigerant to a hydrofluoroolefin-based flammable refrigerant.

11. A method for controlling a refrigerating and air-conditioning apparatus which includes a compressor, a condenser, an expansion device, and an evaporator, has a refrigeration cycle configured by these components being connected by a refrigerant pipe, the method comprising the step of detecting a first power consumption of the compressor, tentatively setting an assumed value of a refrigerant composition, calculating a second power consumption of the compressor based on the assumed value of the refrigerant composition and a pressure of the refrigerant at a suction side of the compressor, a pressure of the refrigerant at a discharge side of the compressor, a temperature of the refrigerant at the suction side of the compressor, and a rotation speed of the compressor, setting the assumed value of the refrigerant composition as a refrigerant composition when the calculated second power consumption of the compressor is within a range predetermined based on the detected first power consumption of the compressor, and setting a value obtained by adding or subtracting a predetermined value δα to the assumed value of the refrigerant composition as the refrigerant composition and recalculating the second power consumption of the compressor when the calculated second power consumption of the compressor is beyond the range controlling, in response thereto, one of an opening degree of the expansion device, a rotation speed of the compressor, and a rotation speed of fans provided in the condenser and the evaporator based on the value or the assumed value of the refrigerant composition which is set.

12. The method of claim 11, wherein in the tentatively setting an assumed value of a refrigerant composition, the refrigerant composition is a proportion of an R32 refrigerant to a hydrofluoroolefin-based flammable refrigerant.

* * * * *